United States Patent [19]

Kramer et al.

[11] Patent Number: 4,838,497

[45] Date of Patent: Jun. 13, 1989

[54] APPARATUS FOR AUTOMATICALLY ROLLING UP MEDIA SHEETS

[75] Inventors: William E. Kramer, Fairport; John E. Forward, Penfield; Michael J. Tracy, Hilton, all of N.Y.

[73] Assignee: Xerox Corporation, Stamford, Conn.

[21] Appl. No.: 155,445

[22] Filed: Feb. 12, 1988

[51] Int. Cl.[4] ..... B65H 27/00; B65H 29/64

[52] U.S. Cl. ..... 242/67.2; 242/76; 242/DIG. 3

[58] Field of Search ..... 242/66, 67.1 R, 67.2, 242/DIG. 3, 76

[56] References Cited

U.S. PATENT DOCUMENTS

| | | | |
|---|---|---|---|
| 2,308 | 1/1977 | Felgbery | 242/66 |
| 2,551,866 | 5/1951 | Bevins et al. | 242/67.2 |
| 2,849,191 | 8/1958 | Gadler | 242/56 |
| 3,052,073 | 9/1962 | Johnson et al. | 53/118 |
| 3,498,559 | 3/1970 | Sames | 242/67.2 |
| 4,067,567 | 1/1978 | McNeil | 242/DIG. 3 X |
| 4,102,512 | 7/1978 | Lewallyn | 242/66 |
| 4,418,874 | 12/1983 | Roldan | 242/76 |
| 4,542,859 | 9/1985 | Gerstenberger | 242/DIG. 3 X |
| 4,720,728 | 1/1988 | Kando | 355/35 |

*Primary Examiner*—Stuart S. Levy
*Assistant Examiner*—Steven M. duBois

[57] ABSTRACT

A roll-up apparatus is provided for automatically rolling up a plurality of media sheets, such as original documents being copied or output copy sheets. In one embodiment, a plurality of flexible, circular guide members are aligned perpendicular to the media sheet feed motion. The first and succeeding sheets are scrolled up within the circular interior space formed by the guide member. The guides are designed to expand radially outward along their width to accomodate the increasing area of successively rolled up media sheets.

2 Claims, 4 Drawing Sheets

APPARATUS FOR AUTOMATICALLY ROLLING UP MEDIA SHEETS

BACKGROUND AND INFORMATION DISCLOSURE STATEMENT

The present invention relates to a device for automatically rolling up media sheets and, more particularly, to an apparatus incorporated into a document reproduction machine which automatically rolls up the original document or copy sheets into tubular form.

There are a number of prior art applications wherein the configuration of a flat article, following a manufacturing or production step, is required to be transformed into a tubular form for convenient removal from a work station. U.S. Pat. Nos. 4,002,308 and 4,102,512 disclose a roll-up mechanism comprising four rollers which define a center aperture in which cut carpet sections of various lengths are rolled up. U.S. Pat. No. 2,849,191 discloses an apparatus for winding paper material into rolls. The apparatus includes two input rollers and two roll-up stations where the sheets are rolled within a central aperture formed between rolled sets. Upon completing the roll-up operation, the paper rolls automatically fall into a container. U.S. Pat. No. 3,052,073 shows a cluster of rollers which form a space therebetween in which sheets are wound. As the rolled sheet diameter expands, bottom rollers are moved away to allow rolled sheets to be removed.

Document reproduction machines capable of copying up to 36" long engineering drawings are known in the art; the Xerox 2510 copier being one example. The 2510 copier operator inserts a copy sheet into a registration position and then introduces an original to be copied into a continuous velocity transport device. The original document, as it emerges from the exposure zone, must be manually retrieved. The output copy may either be retrieved manually, allowed to fall onto a support table or the like. The output copy may also be automatically rolled up for subsequent removal as disclosed in copending application Ser. No. 075,509 filed on July 20, 1987 and assigned to the same assignee as the present invention. This roll-up device incorporates a roll-up assembly comprising a curved baffle arrangement with drive rollers positioned along the circumference. The output copy is moved along a spiral path on the interior surface of the rollup assembly. Upon completion of the roll-up operation, the assembly is pivotally opened and the rolled-up output copy removed.

With the prior art arrangements described above, it is necessary for an operator to manually remove each original as it exits the exposure zone and to remove each copy from the copy exit station or the roll-up assembly, as the case may be. These operations and functions reduce throughput since the time taken to handle originals and copies from the output stations subtracts from the time the operator can be feeding originals into the exposure station. It would therefore be desirable to have an original and a copy output station capable of automatically rolling up one or more original documents, or copies, during a copy operation and storing them in tubular configuration until later removal by an operator. The present invention is therefore directed to an apparatus for automatically rolling up one or more media sheets into a tublar configuration, the apparatus including:

means for accepting said media sheets from a copy input station and for feeding said sheets into a roll-up assembly, the roll-up assembly including;

at least one cylindrical guide member enclosing an interior roll-up space, the guide member at least partially flexible along its circumference.

whereby the media sheets are fed into said guide member and are scrolled within the interior space, the guide member flexing radially outward to accomodate the rolling up of a plurality of media sheets.

BRIEF DESCRIPTION OF THE DRAWINGS

Referring to FIG. 1 of the drawings, there is shown a xerographic type reproduction machine 8 and a sheet roll-up apparatus 10. Machine 8 has a suitable frame 12 on which the machine xerographic components are operatively supported. Briefly, and as will be familiar to those skilled in the art, the machine xerographic components include a recording member, shown here in the form of a rotatable drum 14 having a photoconductive surface. Other photoreceptor types such as a belt or web may instead be contemplated. Operatively disposed about the periphery of photoreceptor 14 is charge corotron 18 for placing a uniform charge on the photoconductive surface of photoreceptor 14, an exposure station 20 where the previously charged photoconductive surface is exposed to image rays of the document 9 being copied or reproduced, development station 24 where the latent electrostatic image created on the photoconductive surface is developed by toner, transfer station 28 with transfer corotrons 29, 30 for transferring the developed image to a suitable copy substrate material such as a copy sheet 32 brought forward in timed relation with the developed image on photoconductive surface, cleaning station 34 and discharge corotron 36 for removing leftover developer from the photoconductive surface and neutralizing residual charges thereon.

Figure 1:
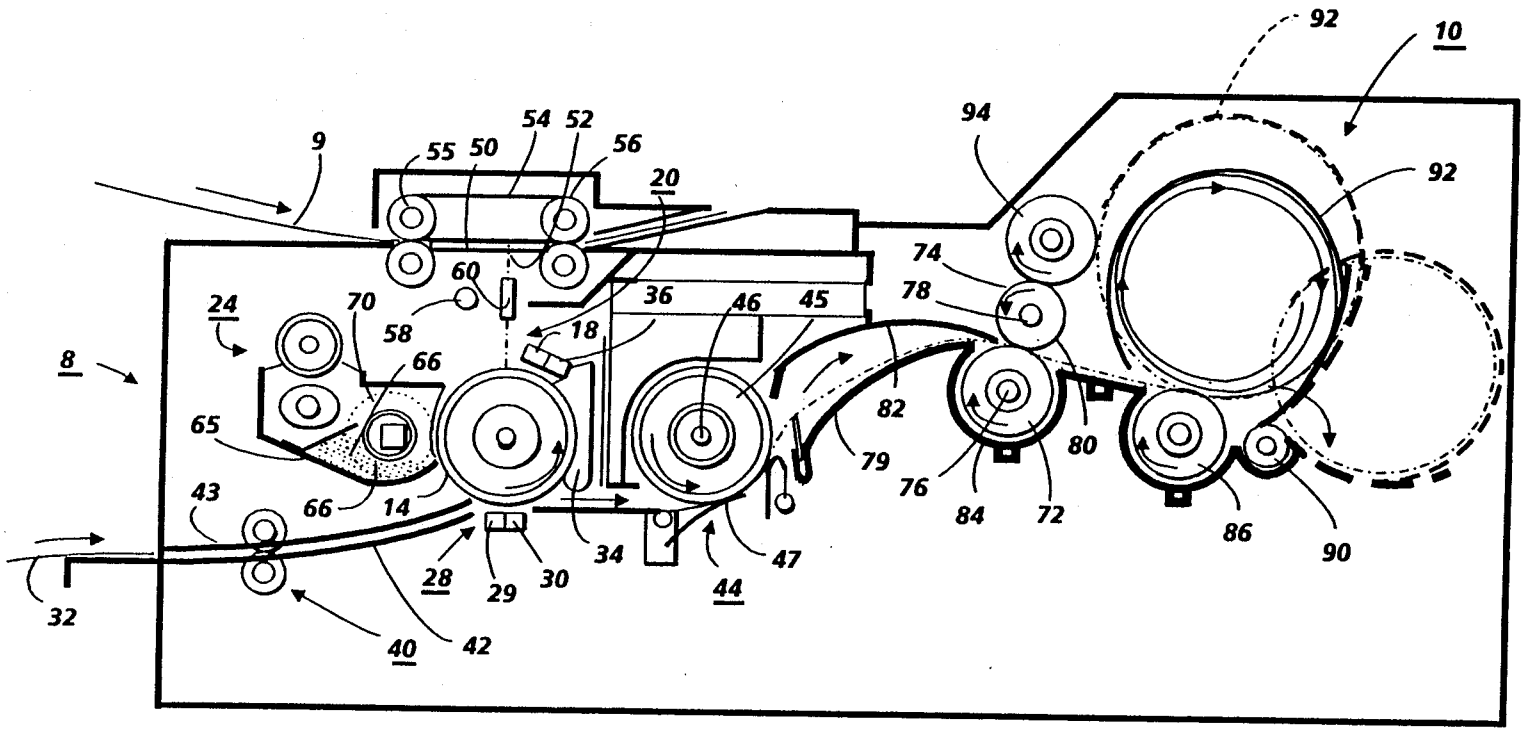
FIG. 1 is a side view of a document reproduction machine incorporating a multiple output sheet roll-up apparatus according to principles of the present invention.

Copy sheets 32 are brought forward to transfer station 28 by feed roll pair 40 and sheet guides 42, 43. Following transfer, the sheet 28 is carried forward to a fusing station 44 where the toner image is fixed by fusing roll 45. Fusing roll 45 is heated by a suitable heater such as lamp 46 disposed within the interior of roll 45. After fixing, the copy sheet 32 enters the document roll-up apparatus 10 whose operation is described in detail below.

Continuing with the description of machine 8, transparent platen 50 supports the document 9 as the document is moved past a scan point 52 by a constant velocity type transport 54. As will be understood, scan point 52 is, in effect, a scan line extending across the width of platen 50 at a desired point where the document is scanned line by line. Transport 54 has input and output document feed roll pairs 55, 56 respectively on each side of scan point 52 for moving document 9 across platen 50 at a predetermined speed. Exposure lamp 58 is provided to illuminate a strip-like area of platen 50 at scan point 52. The image rays from the document line scanned are transmitted by a gradient index fiber lens array 60 to exposure station 20 to expose the phtoconductive surface of the moving photoreceptor 14.

Developing station 24 includes a developer housing 65, the lower part of which forms a sump 66 for holding a quantity of developer. As will be understood by those skilled in the art, the developer comprises a mixture of larger carrier particles and smaller toner or ink particles. A rotatable magnetic brush developer roll 70 is disposed in predetermined operative relation to the photoconductive surface. In developer housing 65, roll 70 serving to bring developer from sump 66 into developing relation with photoreceptor 14 to develop the latent eletrostatic images formed on the photoconductive surface thereof.

Figure 2:
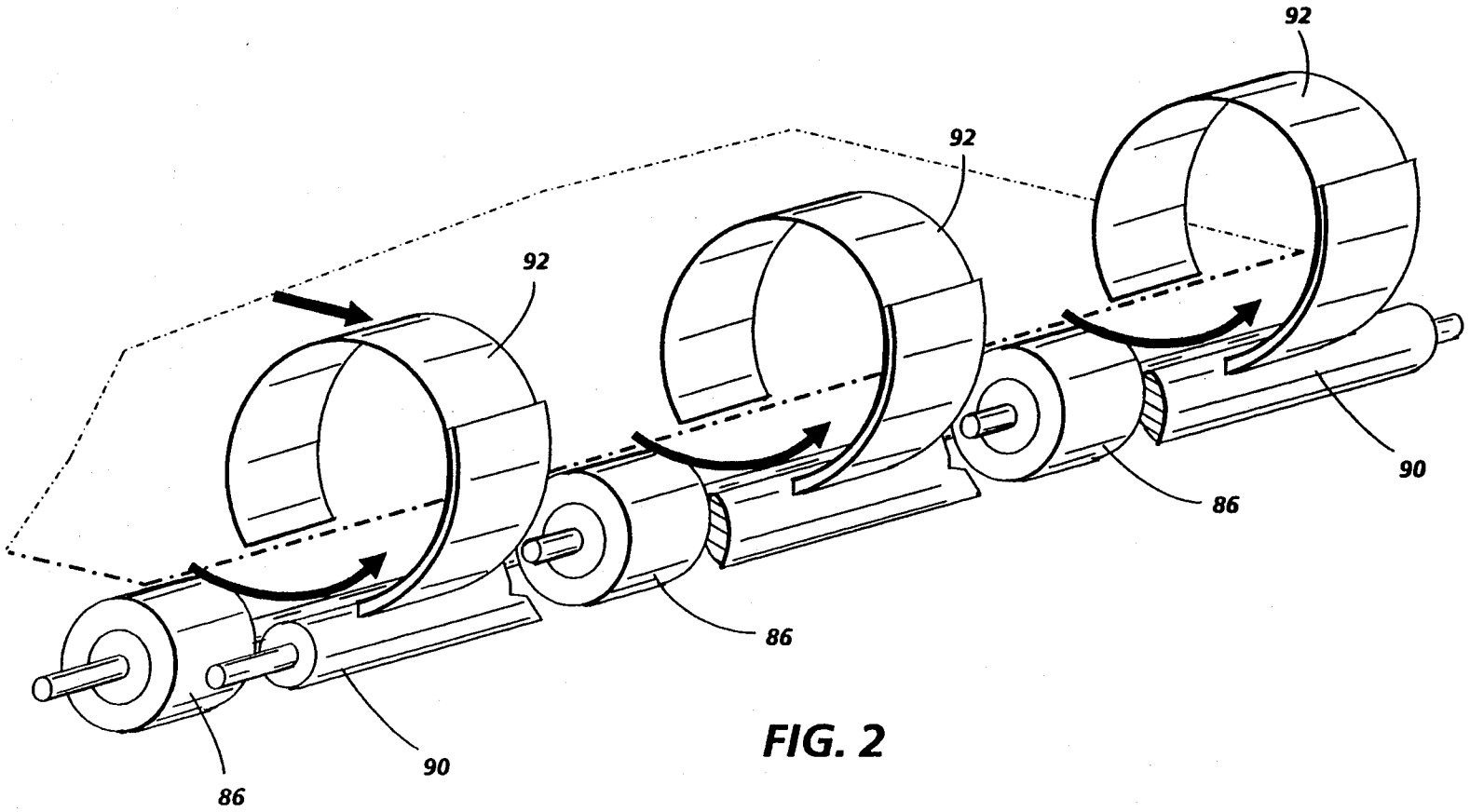
FIG. 2 is a front perspective view of the sheet roll-up apparatus of FIG. 1.

Turning now to the roll-up apparatus 10, shown in side view in the right hand portion of FIG. 1 and in a full width front view in FIG. 2, there is shown two sets of feed rollers 72, 74 which engage the leading edge of sheet 32 as it emerges from the fusing station 44. Fuser station 44 is therefore, for this embodiment, the copy input station. Feed roller sets 72 and 74 comprise a plurality of rollers, a preferred number being two, which are driven in the indicated direction. The rollers are mounted on shafts 76, 78 which are driven by a drive motor (not shown). The sheet, as it emerges from the fusing area, travels along upwardly sloping frame 79. The leading edge is maintained in a generally flat condition against the surface of frame 79 at the entrance to the nip area 80 by a fuser oiler extrusion and guide member 82.

A roller frame 84 partially encloses drive roller 72 and a second set of drive rollers 86 with a flat portion of frame 84 providing support for the copy sheet as it travels between the two rollers. Drive rollers 86 are preferably of foam construction and are driven in the indicated direction by a belt which transfers motion from continuously rotating roll 72. A pivot rod 90 extends along the width of the roll-up apparatus. Connected to the rod 90 are a plurality of generally curved, flexible guide members 92. The number of guides may vary but three guides, spaced as shown, allow for a roll-up sheets of variable widths up to a full 36" width size. Guide members 92 are formed so as to exert a specific compression force in the rest position (solid line). The members 92 and rollers 86 are aligned perpendicular to the path of travel of the copy sheet The circular area defined by the interior of the guides is expandable radially outward as described below.

In operation, as a copy sheet emerges from fusing station 44, its leading edge is guided upward by baffle member 79. Just prior to entering the nip area 80, the leading edge is flattened by the action of guide 82. Rollers 72, 74 engage the leading edge of the sheet and transport the copy sheet into the interior of the space formed by flexible guide members 92. Foam rollers 86 urge the leading edge of the sheet in the indicated direction and the sheet slides upward along the curved interior surface of the guide members. As the copy sheet completes one revolution, the leading edge continues to slide along the inward-facing surface of the partially rolled up copy sheet. When copying an original document document of length 48 inches, the entire output copy is rolled up within the interior space of the guides 92. According to a further aspect of the invention, successive copies can be rolled-up around the rolled up first copy. The leading edge of the second copy is fed between the outside surface of the first rolled up copy and the interior surface of the guide. As the sheet is rolled up through two or more revolutions, guides 92 expands outward to accomodate the increased area of the rolled-up copies whose cumulative diameter increases with continued scrolling. As an indication of this expansion, guides 92 are shown in a radially expanded position following the roll-up of two output copies. Further expansion may continue for up to 4 or 5 copies of the same size. A guide roller 94 is driven in the indicated direction by the action of roller 74. The function of roller 94 is to urge the lead edge of the copy sheet downward and inward as the guides expand outward. Upon completion of the rolling-up operation, pivot guide 92 enables the guides to be pivoted clockwise to an open position facilitating the removal of the rolled up copies.

Figure 3:
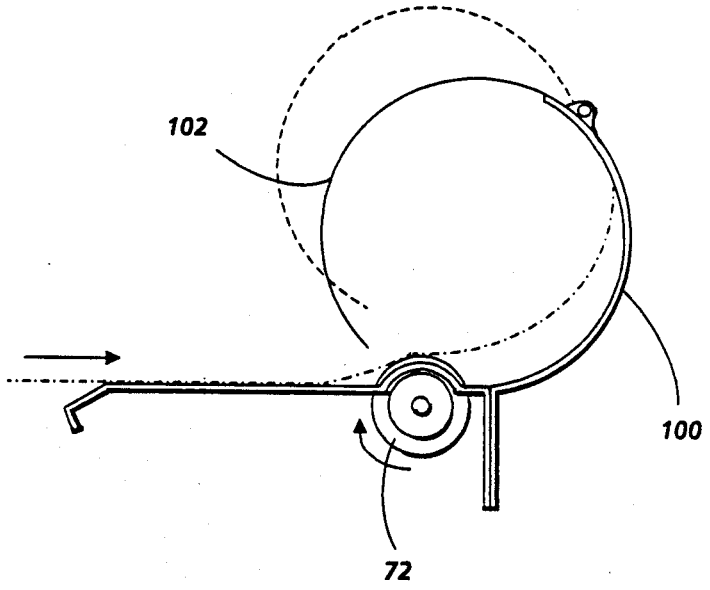
FIG. 3 is a side view of a second embodiment of the guide member of FIGS. 1 and 2.
Figure 4:
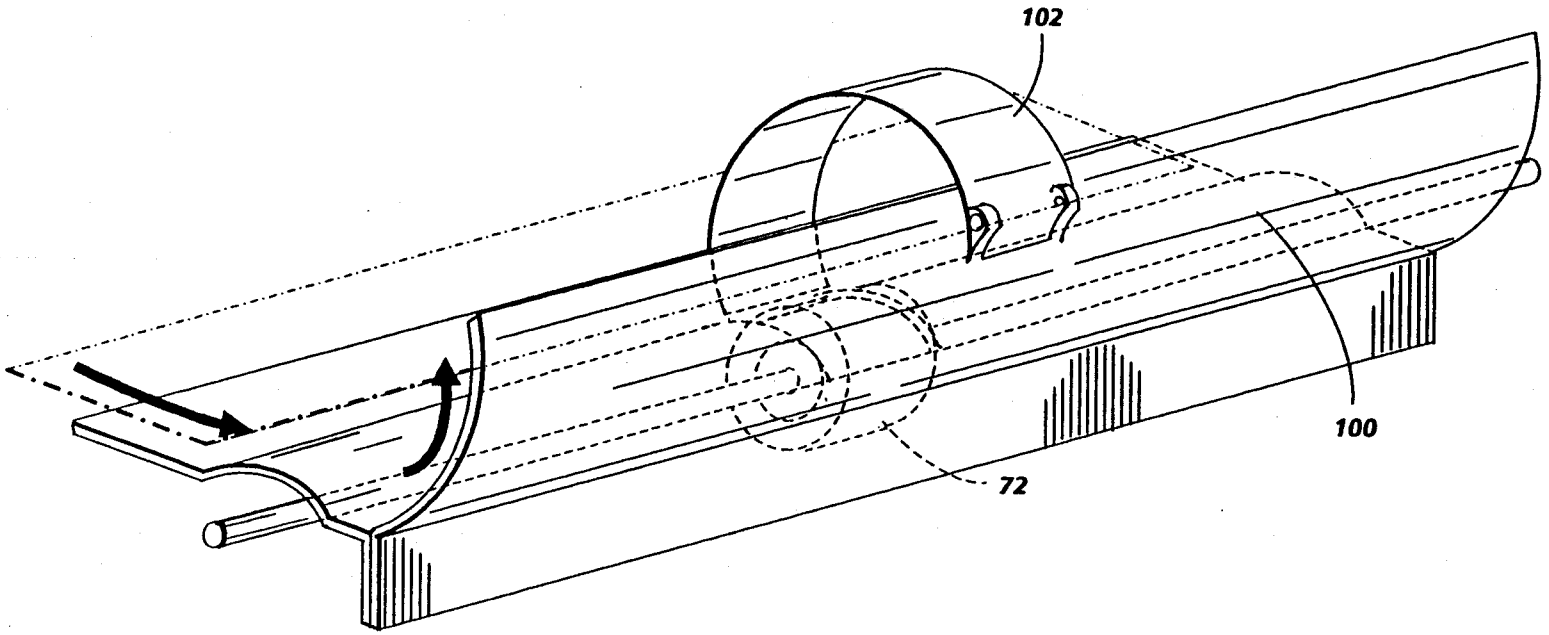
FIG. 4 is a front perspective view of the guide member of Figure 2.

FIG. 3 and 4 show a side and front view, respectively, of a rollup assembly showing a second embodiment of guide member 92. In this embodiment guide 92 comprises a full width baffle member 100 having a ribbed interior teflon coating connected to one or more narrow flexible circular guides 102 (only one shown in FIG. 4). This guide embodiment operates in the same manner as the first embodiment but the flexible baffle member 100 maximizes performance with folded or wrinkled originals.

While the description thus far has been concentrated on a copy output roll-up station, the invention, in either embodiment, can also be adapted for use as an original document scrolling device. For this application, the roll-up apparatus would be positioned at the right of transport 54 and aligned so as to introduce the leading edge of the original document, as it exits the transport, into the nip formed by rollers 72, 74.

While the invention has been described with reference to the structure disclosed, it is not confined to the details set forth, but is intended to cover such modifications or changes as may come within the scope of the invention.

What is claimed is:

1. Apparatus for rolling one or more media sheets into a tubular configuration, the apparatus including:

means for accepting said media sheets from a media output station and for feeding said sheets into a roll-up assembly, the roll-up assembly including a guide member comprising a rigid semicircular member extending the width of the process path, and at least one flexible, curved guide member connected to the rigid member, the combination forming a circular assembly which defines a roll-up interior space, whereby the media sheets are fed into said guide member and are scrolled within the interior space, the guide member flexing radially outward to accommodate the rolling up of one or more copy sheets.

2. The apparatus of claim 1 wherein said rigid semicircular member has a ribbed surface adjacent the media travel path.

* * * * *